US010196724B2

(12) United States Patent
Han et al.

(10) Patent No.: US 10,196,724 B2
(45) Date of Patent: Feb. 5, 2019

(54) METHOD FOR MANUFACTURING NI-BASED SUPER-HEAT-RESISTANT ALLOY

(71) Applicants: HITACHI METALS, LTD., Tokyo (JP); TOHOKU UNIVERSITY, Sendai-shi, Miyagi (JP)

(72) Inventors: Gang Han, Yasugi (JP); Koji Sato, Yasugi (JP); Tomonori Ueno, Yasugi (JP); Akihiko Chiba, Sendai (JP)

(73) Assignees: HITACHI METALS, LTD., Tokyo (JP); TOHOKU UNIVERSITY, Sendai-shi (JP)

( * ) Notice: Subject to any disclaimer, the term of this patent is extended or adjusted under 35 U.S.C. 154(b) by 0 days.

(21) Appl. No.: 15/548,447

(22) PCT Filed: Feb. 3, 2016

(86) PCT No.: PCT/JP2016/053243
§ 371 (c)(1),
(2) Date: Aug. 3, 2017

(87) PCT Pub. No.: WO2016/129485
PCT Pub. Date: Aug. 18, 2016

(65) Prior Publication Data

US 2018/0023176 A1 Jan. 25, 2018

(30) Foreign Application Priority Data

Feb. 12, 2015 (JP) ..... 2015-025245

(51) Int. Cl.
*C22F 1/10* (2006.01)
*C22C 19/05* (2006.01)
*C22F 1/00* (2006.01)

(52) U.S. Cl.
CPC ..... *C22F 1/10* (2013.01); *C22C 19/05* (2013.01); *C22C 19/056* (2013.01); *C22F 1/00* (2013.01)

(58) Field of Classification Search
CPC ..... C22F 1/10
See application file for complete search history.

(56) References Cited

FOREIGN PATENT DOCUMENTS

| | | | |
|---|---|---|---|
| JP | 10-46278 | A | 2/1998 |
| JP | 2001-512785 | A | 8/2001 |
| JP | 2015-059239 | A | 3/2015 |
| WO | 2015/008343 | A1 | 1/2015 |

OTHER PUBLICATIONS

Borodians'ka, Hanna, et al. "Fabrication of thin foils of binary Ni—Al y/y' two-phase alloys by cold rolling. " Intermetallics 10.3 (2002): 255-262.*

International Search Report for PCT/JP2016/053243, dated Apr. 26, 2016.

* cited by examiner

*Primary Examiner* — Jessee R Roe
(74) *Attorney, Agent, or Firm* — Sughrue Mion, PLLC

(57) ABSTRACT

A method for manufacturing a Ni-based super-heat-resistant alloy includes: a first cold working step for cold working a Ni-based super-heat-resistant alloy ingot, which has a composition in which the γ' mole ratio is at least 40%, at a working ratio of 5% to less than 30%; and a first heat treatment step for heat-treating the cold worked material, on which the first cold working was performed, at a temperature exceeding the γ' solid solution temperature. It is preferable that the manufacturing method also includes a second cold working step for performing, after the first heat treatment step, a second cold working on the heat-treated material at a working ratio of at least 20%, and a second heat treatment step for heat-treating the second cold worked material, on which the second cold working has been performed, at less than the γ' solvus temperature.

7 Claims, 5 Drawing Sheets

METHOD FOR MANUFACTURING NI-BASED SUPER-HEAT-RESISTANT ALLOY

CROSS REFERENCE TO RELATED APPLICATIONS

This application is a National Stage of International Application No. PCT/JP2016/053243 filed Feb. 3, 2016 (claiming priority based on Japanese Patent Application No. 2015-025245 filed Feb. 12, 2015), the contents of which are incorporated herein by reference in their entirety.

TECHNICAL FIELD

The present invention relates to a method for producing a Ni-based heat-resistant super alloy, particularly to a method for producing an intermediate material for blooming.

BACKGROUND ART

A Ni-based heat-resistant superalloy, such as a 718 alloy, has been widely used as an aircraft engine or a gas turbine for power generation. Along with the gas turbine has been improved to have high performance and fuel efficiency, components resistant to higher temperature are required. In order to improve the heat resistance of the Ni-based heat-resistant super alloy, it is most effective to increase an amount of gamma prime (hereinafter referred to as γ') phase that is a precipitation strengthening phase composed of an intermetallic compound represented by a composition such as $Ni_3(Al, Ti)$. It is required that the γ' molar ratio in the Ni-based heat-resistant super alloy is much more increased to satisfy the high heat resistance and high strength.

However, increase of the γ' phase makes it difficult to forge the alloy due high deformation resistance during hot working. Furthermore, as the γ' molar ratio becomes greater, segregation tends to generate during casting solidification, and the ingot includes more high-temperature unstable phases and casting defects, as well as the ingot becomes less hot-forgeable. In addition, a large amount of Al and Ti, which are γ' forming elements, makes the alloy have a lower solidus temperature and a higher recrystallization temperature of the alloy, and thus a temperature range in which the alloy can be forged becomes narrowed, since hot forging is in general conducted at a temperature not higher than the solidus temperature and not lower than the recrystallization temperature. Conventionally, it has been considered to be difficult to hot-forge an alloy including the γ' phase by not less than 40% by mol, since there is practically no temperature range for forging. Accordingly, it has been proposed for producing the Ni-based heat-resistant super alloy having a high γ' molar ratio to avoid the difficulty of forging working, such as cast products that is used as cast or a powder metallurgy process for producing an initial ingot by sintering (for example, see JP 10-46278 A (Patent Literature 1)).

CITATION LIST

Patent Literature

PATENT LITERATURE 1: JP 10-46278 A

SUMMARY OF INVENTION

The cast products that are used as cast disclosed in the method of Patent Literature 1 include a coarse cast structure, casting segregation of alloying elements and casting defects, and thus dynamic properties and reliability are lowered. Therefore, they can not be applied to components that are required to have high reliability, such as a turbine disk. Although the powder metallurgy process can produce an alloy having a high γ' molar ratio as a sintered material, the process is complicated compared with a melting and forging process. Furthermore, advanced management is essential to prevent contamination of impurities in the production process, and thus, there is a problem that the production needs high cost. Therefore, the cast material and the sintered material are limited to some special applications.

An object of the present invention is to resolve the problem in producing the high γ' phase Ni-based heat-resistant super alloy, and provide a method for producing the Ni-based heat-resistant super alloy, that makes the hot working possible.

According to an aspect of the present invention, provided is a method for producing a Ni-based heat-resistant super alloy, including:

preparing an ingot of the Ni-based heat-resistant super alloy having such a composition that the alloy includes not less than 40 mol % of a γ' phase;

a first cold work step of cold-working the ingot at a working ratio of not less than 5% but less than 30%; and a first heat treatment step of heat-treating the first-cold-worked material at a temperature exceeding a solid solution temperature of the γ' phase (hereinafter referred to as "γ' solvus temperature").

Preferably, the first heat treatment is conducted at a temperature not higher than the gamma prime solid solution temperature plus 40° C. and lower than a solidus temperature of the alloy.

In one embodiment of the present invention, the production method preferably includes:

a second cold work step of cold-working the first-heat-treated material at a working ratio of not less than 20%; and a second heat treatment step of heat-treating the second-cold-worked material at a temperature lower than the gamma prime solid solution temperature.

Preferably, the second heat treatment is conducted at a temperature not lower than the gamma prime solid solution temperature minus 80° C.

In one embodiment of the present invention, the first cold working or the second cold working is preferably conducted by forging, elongation working, or injection working, or a combination thereof.

In one embodiment of the present invention, the Ni-based heat-resistant super alloy preferably has a composition comprising, by mass: 0.001 to 0.250% C; 8.0 to 22.0% Cr; not more than 28.0% Co; 2.0 to 7.0% Mo; not more than 6.0% W; 2.0 to 8.0% Al; 0.5 to 7.0% Ti; not more than 4.0% Nb; not more than 3.0% Ta; not more than 10.0% Fe; not more than 1.2% V; not more than 1.0% Hf; 0.001 to 0.300% B; 0.001 to 0.300% Zr; and the balance of Ni and inevitable impurities.

According to the present invention, it becomes easy to conduct hot working, such as blooming forging, of a hard-to-work Ni-based super alloy having a γ' molar ratio of not less than 40% which has been conventionally considered difficult to hot work such as hot forging. According to the method, a high γ' phase Ni-based heat-resistant super alloy can be used for producing e.g. a high-performance turbine disk for an aircraft or for power generation.

Other advantages, features and details of the present invention will become apparent with reference to following description and accompanying drawings of non-limiting examples.

DESCRIPTION OF EMBODIMENTS

Figure 1:
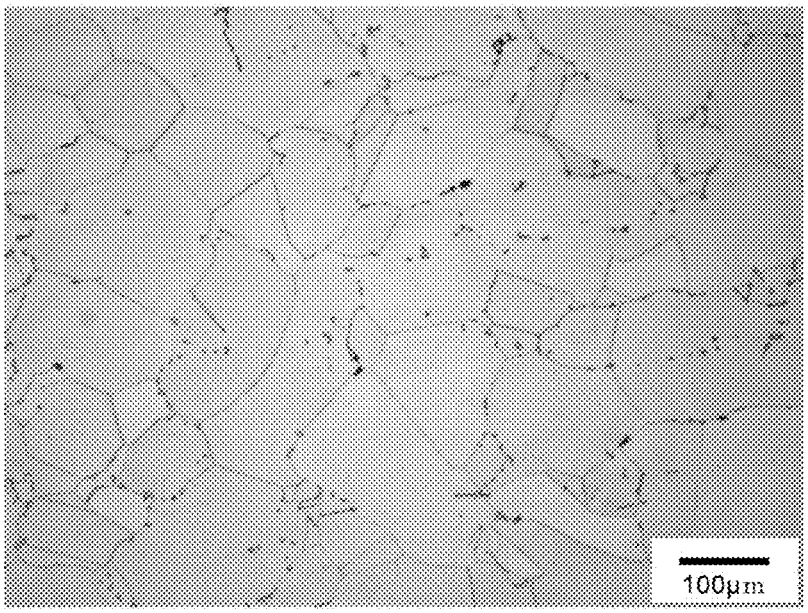
FIG. 1 is a photograph of a metal structure of a Ni-based heat-resistant super alloy (No. 1) produced by the production method according to the present invention, that is made of No. A alloy subjected to a first cold working and a first heat treatment.
Figure 2:
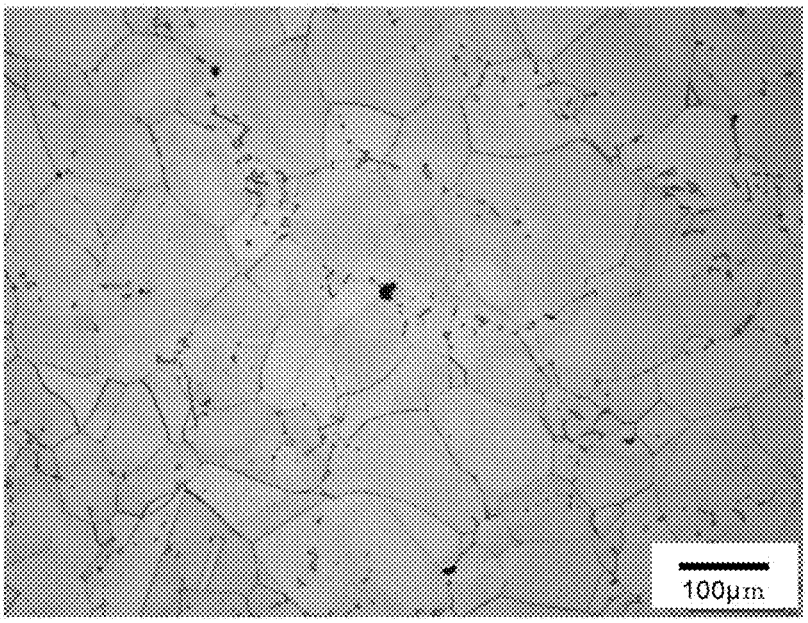
FIG. 2 is a photograph of a metal structure of a Ni-based heat-resistant super alloy (No. 2) produced by the production method according to the present invention, that is made of No. A alloy subjected to a first cold working and a first heat treatment.
Figure 3:
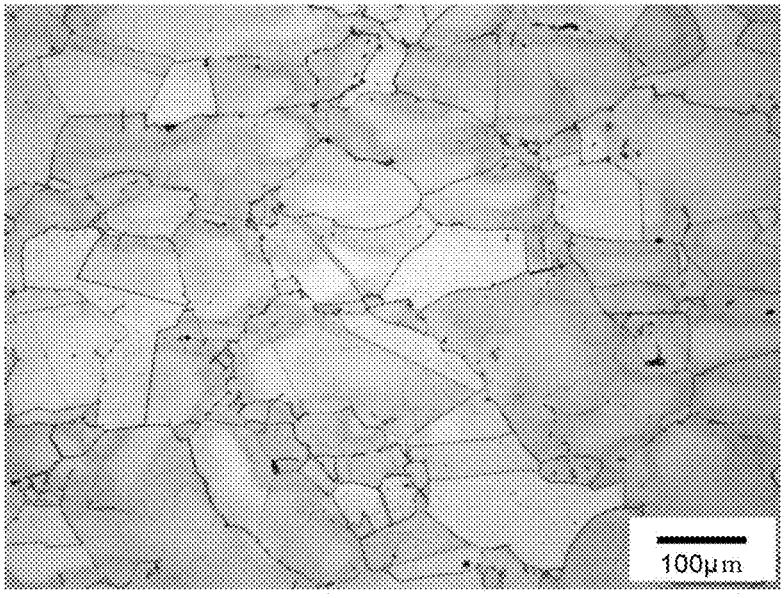
FIG. 3 is a photograph of a metal structure of a Ni-based heat-resistant super alloy (No. 7) produced by the production method according to the present invention, that is made of No. A alloy subjected to a first cold working and a first heat treatment.
Figure 4:
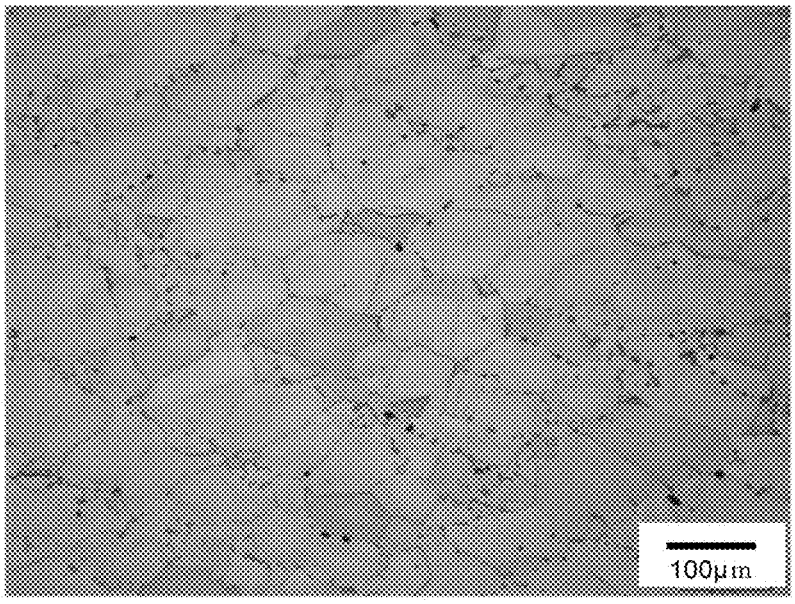
FIG. 4 is a photograph of a metal structure of a Ni-based heat-resistant super alloy (No. 8) produced by the production method according to the present invention, that is made of No. A alloy subjected to a first cold working and a first heat treatment.
Figure 5:
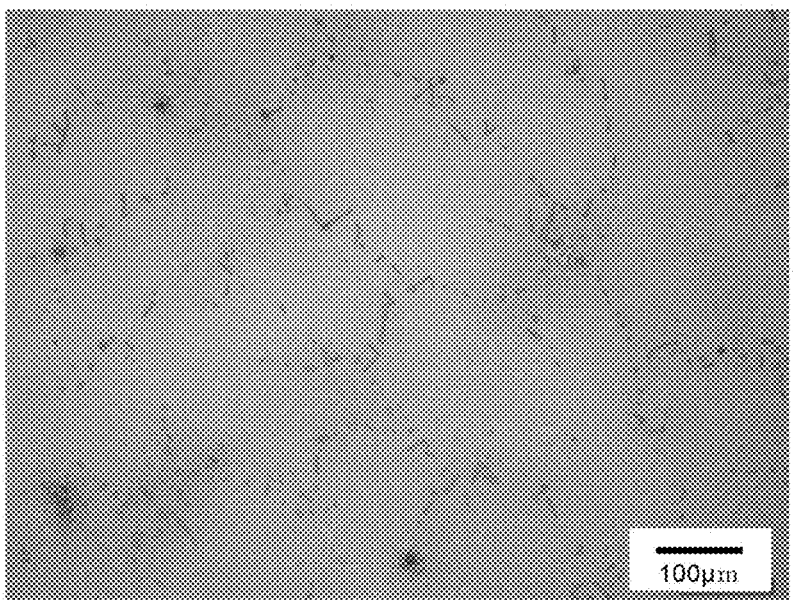
FIG. 5 is a photograph of a metal structure of a comparative example of No. 14 made of No. A alloy.

Hereinafter, each step of the production method according to the present invention will be described as well as reasons for limitation of conditions thereof.

<Ingot>

For a Ni-based super alloy to be applied in the production method according to the present invention, prepared is an ingot having a composition such that the alloy includes a γ' phase by not less than 40 mol %. A method for producing the ingot may include a conventional method such as vacuum melting, vacuum arc remelting, or electroslag remelting. Please note that the method according to the present invention described later is particularly suitable for working on a Ni-based super alloy having a γ' phase ratio of 60% to 70%, which can not be worked by a conventional hot forging blooming technique.

<First Cold Working Step>

In the present invention, the ingot is cold worked first. While the mechanism of recrystallization through cold working and recrystallizing heat treatment has not yet been fully elucidated, cold working is employed for following reasons in the present invention. In the first place, recovery and dynamic recrystallization are not so generated during the cold working process as compared with hot forging working, and thus strain energy by plastic working can be most effectively introduced into the material. Next, since an ingot includes nonuniformly distributed eutectic γ' phase, carbides and other precipitation phases and it is advantageous to produce sites having high strain gradients with use of the nonuniformity of microplastic deformation in an order of micrometers. A high strain gradient site tends to be a starting point of recrystallize nucleus generation. With the application of the cold working, a recrystallized structure can be successfully obtained by a low cold working ratio and an appropriate heat treatment that will be described later.

A working ratio of the first cold working is made be not less than 5% but less than 30% in the present invention. In principle, recrystallization of a plastically deformed material may be facilitated as an amount of strain increases. When the working ratio is less than 5%, introduction of strain into the ingot becomes insufficient, and the recrystallization can not be generated even if a subsequent heat treatment is applied. Therefore, a lower limit of the working ratio of the first cold working is made 5%. In order to more reliably obtain the recrystallized structure, the lower limit of the working ratio of the first cold working is preferably 8%.

As the working ratio is higher, the recrystallization is facilitated through the subsequent heat treatment, and the recrystallized grains can be made finer. Thus, high working ratio of the first cold working is preferable. However, an ingot as cast, or a soaked ingot includes a coarse dendritic structure, solidification segregation, casting defects or the like existing in the ingot, and they restrict a cold working ductility. Accordingly, an upper limit of the working ratio of the first cold working is made be less than 30% in consideration of risk of generation of defects during the cold working. The upper limit is preferably 20%, and more preferably 15%.

Figure 8:
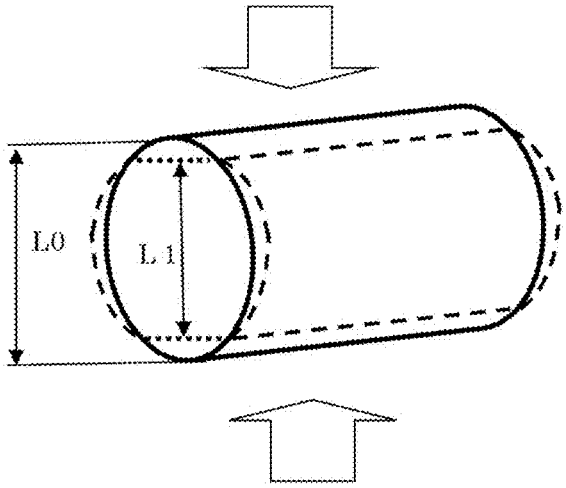
FIG. 8 is a schematic diagram of cold working of compression from a radial direction. A solid line shows a material profile before the working and a dotted line shows a profile after the working.
Figure 9:
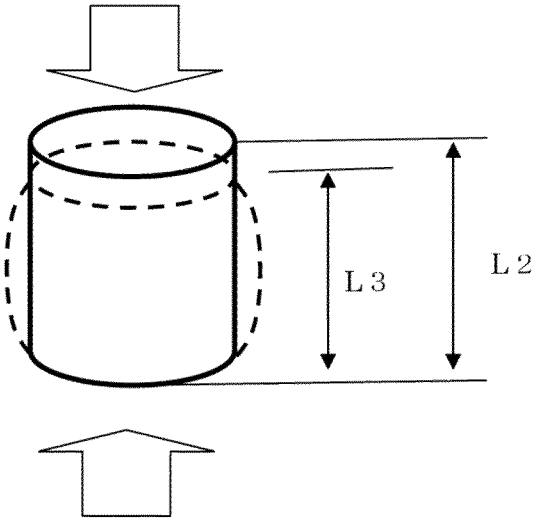
FIG. 9 is a schematic diagram of cold working of upset compression from an axial direction. A solid line shows a material profile before the working and a dotted line shows a profile after the working.

Representative working method includes a method of compressing in a radial direction as shown in FIG. 8, and a method of compressing in a longitudinal direction such as in the upset forging shown in FIG. 9, in which a diameter is hardly changed. A compressive force is applied in a direction of an arrow in both FIGS. 8 and 9.

For example, a working ratio of the radially compressing method as shown in FIG. 8 is defined by following equation (1):

$$\text{Working ratio } (\%) = ((L0 - L1)/L0) \times 100\% \quad (1)$$

where, L0 is a diameter before the cold working, and L1 is a dimension after the compression working in the radial direction.

In addition, the method of compressing from the radial direction includes, for example, a working method, such as extend forging, in which a radial cross-sectional area is made smaller and a length of the material is made longer. In the case, the working ratio may be obtained by diameters before and after the extend forging. Furthermore, in a working method as described later in Example 1 may be applied to the present invention. For example, a round bar material is constrained in a longitudinal direction thereof and a rotation at a predetermined angle about the axial and a compression in the radial direction are repeated. For the method, sizes in the longitudinal direction and the radial direction are hardly changed as a result, while strain can be applied uniformly to the material. In the case, the working ratio is calculated by the above equation (1) with a change in the radial direction for each pass.

The working ratio of the upset compression shown in FIG. 9 is defined by equation (2):

$$\text{Working ratio } (\%)=((L2-L3)/L2)\times 100\% \quad (2)$$

where L2 is a length (or height) before the compression working and L3 is a length (or height) after the working.

<First Heat Treatment Step>

Next, a first heat treatment is conducted on the first cold-worked material in the production method according to the present invention. The first heat treatment is conducted at a temperature that exceeds a γ' solvus temperature of the Ni-based super alloy to be worked (supersolvus heat treatment). The present inventors found that when a first-cold-worked material is heat-treated, recrystallization proceeds as a heat treatment temperature increases. In particular, it was found that the behavior largely changes above and below the γ' solvus temperature. A sound recrystallized structure can not be obtained at a temperature not higher than the γ' solvus temperature with low strain deformation. However, not less than 95% of a recrystallized structure was obtained at a temperature range exceeding the γ' solvus temperature. Therefore, the first heat treatment is conducted at a temperature exceeding the γ' solvus temperature of the Ni-based super alloy. A lower limit of the first heat treatment temperature for obtaining a more sound recrystallized structure is preferably a temperature of the γ' solvus temperature plus 5° C., and more preferably a temperature of the γ' solvus temperature plus 10° C.

Please note that an upper limit of the first heat treatment temperature for maintaining the sound recrystallized structure is lower than a solidus temperature of the Ni-based super alloy. If heated at a temperature not lower than the solidus temperature, the Ni-based super alloy partially starts to melt and this can not be said as a heat treatment. Furthermore, when the first heat treatment temperature becomes excessively high, recrystallized grains are facilitated to grow and become coarse. Therefore, an upper limit of the first heat treatment temperature is preferably a temperature of the γ' solvus temperature plus 40° C., while the upper limit is a lower temperature between this temperature and the solidus temperature. More preferably, the upper limit of the first heat treatment temperature is a temperature of the γ' solvus temperature plus 20° C. while the upper limit is selected to be a lower temperature between this temperature and the solidus temperature.

Combining the first cold working and the first heat treatment, not less than 90% of the recrystallization ratio can be obtained, for which hot working can be applied on the Ni-based super alloy.

The ingot has a cast structure and has coarse grains. Moreover, the ingot often includes columnar crystals that have anisotropy depending on a cooling direction. Such cast structure is subject to nonuniform macrosplastic deformation in an order of millimeter during a hot deformation, and thus cracks tend to occur in an early stage during a hot working. A recrystallized structure is composed of equiaxial crystal and thus fine grains can be produced. Therefore, the hot deformation becomes uniform, and a local dislocation accumulation hardly occurs. Accordingly, cracks are suppressed during the hot working, and thus a hot workability is excellent.

<Second Cold Working Step and Second Heat Treatment Step>

While the combination of the first cold working and the first heat treatment can generate the recrystallized grains that are required for facilitating the hot working according to the present invention, it is preferable to further conduct a second cold working and a second heat treatment in order to make the recrystallized structure fine.

In the present invention, a working ratio of the second cold working is made be not less than 20%, and a temperature for the second heat treatment is made be lower than the γ' solvus temperature (subsolvus heat treatment). As described above, as the cold working ratio is greater, recrystallization ratio becomes greater through the subsequent second heat treatment and finer grains are obtained. In order to obtain a sound recrystallized structure for sufficient working ductility in a post-process hot forging, a lower limit of the working ratio of the second cold working is 20%. For a finer uniform recrystallized structure, the lower limit of the working ratio of the second cold working step is preferably 30%, and more preferably 40%. On the other hand, while an upper limit of the working ratio is not particularly defined, it is realistic that the upper limit of the working ratio is 80%, in view of avoiding cracks during the second cold working.

The temperature for the second heat treatment is lower than the γ' solvus temperature for following reasons. Although the recrystallization is facilitated by a supersolvus heat treatment at a temperature exceeding the γ' solvus temperature, the recrystallized grains are coarse. On the other hand, while the recrystallization proceeds slowly by a sub-solvus heat treatment, the obtained recrystallized structure is fine. By a combination of the second cold working and the second heat treatment of the sub-solvus heat treatment, fine recrystallized structure can be achieved. Accordingly, the temperature of the second heat treatment in the present invention is set to be less than the γ' solvus temperature. For more reliably refining the recrystallized structure, the upper limit of the temperature in the second heat treatment is preferably the γ' solvus temperature minus 10° C., and more preferably the γ' solvus temperature minus 20° C. On the other hand, when the second heat treatment temperature is extremely low, the recrystallization ratio may be lowered. Thus, a lower limit of the second heat treatment temperature is preferably the γ' solvus temperature minus 80° C., more preferably the γ' solvus temperature minus 50° C., and furthermore preferably the γ' solvus temperature minus 40° C.

By further refining the recrystallized grains, effect of suppressing the local dislocation accumulation and uniformity of the hot deformation are further improved, and hot workability can be further improved.

Preferably, forging such as pressing or extend forging, elongation working such as swaging, or injection working such as shot blasting or shot peening may be applied to the above-described cold working. The cold working is conducted in order to introduce strain in the Ni-based super alloy ingot. While any methods capable of introducing strain may be applied, forging, elongation working, or injection working are preferable in consideration that the material is an ingot. Since it is difficult to cold work at a working ratio of not less than 5% by injection working alone, it is preferable to combine it with forging or elongation working. The injection working introduces strain mainly in an ingot surface. Since cracking of the ingot generates from the surface as a starting point, the injection working is suitable for the cold working on the ingot made of the Ni-based heat-resistant super alloy that particularly easily cracks. From the viewpoint of working efficiency and cost, a hydraulic press (forging), for example, is preferable since an amount of strain to be introduced and a strain rate are easily controlled and strain energy can be efficiently accumulated in the material.

Next, a preferable composition of the Ni-based heat-resistant super alloy for the production method according to the present invention will be described. While the present invention can be widely applied as far as compositions have a γ' molar ratio of not less than 40%, following composition is particularly preferable among them. The composition is represented by mass %.

<C: 0.001 to 0.250%>

Carbon has an effect of increasing strength of grain boundary. The effect is obtained when a carbon content is not less than 0.001%. In a case where carbon is excessively included, coarse carbides are formed and strength and hot workability are lowered. Therefore, an upper limit is 0.250%. A lower limit is preferably 0.005%, and more preferably 0.010%. Furthermore, the upper limit is preferably 0.150%, and more preferably 0.110%.

<Cr: 8.0 to 22.0%>

Cr is an element that improves oxidation resistance and corrosion resistance. In order to obtain the effect, a Cr content is required to be not less than 8.0%. When Cr is excessively included, embrittlement phases such as σ phase are formed, and strength and hot workability are lowered. Therefore, an upper limit is 22.0%. A lower limit is preferably 9.0%, and more preferably 9.5%. Furthermore, the upper limit is preferably 18.0%, and more preferably 16.0%.

<Co: Not More than 28.0%>

Co improves stability of a structure. Even when a strengthening element Ti is largely included, Co may maintain hot workability. Co is one of selective elements that can be included in a total range of not more than 28.0% in a combination with other elements. When a Co content is increased, hot workability is improved. In particular, addition of Co is effective for a hard-to-work Ni-based heat-resistant super alloy. On the other hand, Co is expensive and a cost is increased. In a case where Co is added for the purpose of improving the hot workability, a lower limit is preferably 8.0%, and more preferably 10.0%. Furthermore, an upper Co limit is preferably 18.0%, and more preferably 16.0%. In addition, in a case where Co is not substantially added (an inevitable impurity level of the raw material) as a result of γ' forming elements and balance of a Ni matrix, the lower limit of Co may be 0%.

<Fe: Not More than 10.0%>

Fe is one of selective elements that are used as substitute for expensive Ni or Co, and thus are effective for reducing an alloy cost. In order to obtain the effect, it may be decided whether Fe is added, in view of combination with other elements. When Fe is excessively included, embrittlement phases such as σ phase are formed and strength and hot workability are lowered. Therefore, an upper limit of Fe is 10.0%. The upper limit is preferably 9.0%, and more preferably 8.0%. On the other hand, in a case where Fe is not substantially added (an inevitable impurity level of the raw material) as a result of the γ' forming elements and balance of a Ni matrix, a lower limit of Fe may be 0%.

<Mo: 2.0 to 7.0%>

Mo contributes to solid-solution strengthening of a matrix, and has an effect of improving high-temperature strength. In order to obtain the effect, a Mo content is required to be not less than 2.0%. When the Mo content is excessively high, intermetallic compound phases are formed, and the high-temperature strength is impaired. Therefore, an upper limit is 7.0%. A lower limit is preferably 2.5%, and more preferably 3.0%. Furthermore, the upper limit is preferably 5.0%, and more preferably 4.0%.

<W: Not More than 6.0%>

Similar to Mo, tungsten is one of selective elements that contribute to solid-solution strengthening of a matrix. When a W content is excessively high, harmful intermetallic compound phases are formed, and high-temperature strength is impaired. Therefore, an upper limit is 6.0%. The upper limit is preferably 5.5%, and more preferably 5.0%. In order to more reliably obtain the effect of W, a lower limit of W is favorably 1.0%. Furthermore, combined addition of W and Mo may have more solid-solution strengthening effect. In a case of the combined addition, a W content to be added is preferably not less than 0.8%. In addition, in a case where W is not substantially added (an inevitable impurity level of the raw material) as a result of sufficient addition of Mo, the lower limit of W may be 0%.

<V: Not More than 1.2%>

Vanadium is one of selective elements that are useful for solid-solution strengthening of a matrix and grain boundary strengthening by forming carbides. In order to more reliably obtain the effect of V, a lower limit of V is favorably 0.5%. When V is excessively added, high-temperature unstable phases are generated in a production process, which adversely effect on manufacturability and high-temperature dynamic performance. Therefore, an upper limit of V is 1.2%. The upper limit is preferably 1.0%, and more preferably 0.8%. In addition, in a case where the V is not substantially added (an inevitable impurity level of the raw material) as a result of balance with other alloy elements in the alloy, the lower limit of V may be 0%.

<Al: 2.0 to 8.0%>

Al is an essential element that forms a γ' ($Ni_3Al$) phase as a strengthening phase and improves high-temperature strength. In order to obtain the effect, an Al content is required to be at least 2.0%. However, excessive addition thereof lowers hot workability, and causes material defects such as cracks during working. Therefore, the Al content is limited to 2.0 to 8.0%. A lower limit is preferably 2.5%, and more preferably 3.0%. Furthermore, an upper limit is preferably 7.5%, and more preferably 7.0%.

<Ti: 0.5 to 7.0%>

Ti is an essential element, similar to Al, that forms a γ' phase to solid-solution strengthen the γ' phase and increase high-temperature strength. In order to obtain the effect, a Ti content is required to be at least 0.5%. When Ti is excessively added, the gamma prime phase becomes unstable and coarse at a high temperature. Furthermore, a harmful η (eta) phase is formed, and hot workability is impaired. Therefore, an upper limit of Ti is 7.0%. In consideration of other γ' forming elements and balance of a matrix, a lower limit of Ti is preferably 0.7%, and more preferably 0.8%. Furthermore, the upper limit is preferably 6.5%, and more preferably 6.0%.

<Nb: Not More than 4.0%>

Nb is one of selective elements, similar to Al and Ti, that forms a γ' phase to solid-solution strengthen the γ' phase and increase high-temperature strength. In order to more reliably obtain the effect of Nb, a lower limit of Nb is favorably 2.0%. When Nb is excessively added, a harmful δ (delta) phase is formed, and hot workability is impaired. Therefore, an upper limit of Nb is 4.0%. The upper limit is preferably 3.5%, and more preferably 2.5%. In a case where Nb is not substantially added (an inevitable impurity level of the raw material) as a result of addition of other γ' forming elements, the lower limit of Nb may be 0%.

<Ta: Not More than 3.0%>

Ta is one of selective elements, similar to Al and Ti, that forms a γ' phase to solid-solution strengthen the γ' phase and increase high-temperature strength. In order to more reliably obtain the effect of Ta, a lower limit of Ta is favorably 0.3%. When Ta is excessively added, the gamma prime phase becomes unstable and coarse at a high temperature. Furthermore, a harmful η (eta) phase is formed, and the hot workability is impaired. Therefore, an upper limit of Ta is 3.0%. The Ta content is preferably not more than 2.5%. On the other hand, in a case where Ta is not substantially added (an inevitable impurity level of the raw material) as a result of addition of other γ' forming elements such as Ti and Nb and balance of a matrix, the lower limit of Ta may be 0%.

<Hf: Not More than 1.0%>

Hf is one of selective elements that are useful for improving oxidation resistance of an alloy and strengthening grain boundary by carbides formation. In order to more reliably obtain the effect of Hf, a lower limit of Hf is favorably 0.1%. When Hf is excessively added, oxides are formed and high-temperature unstable phases are generated in a production process, which adversely effects on manufacturability and high-temperature dynamic performance. Therefore, an upper limit of Hf is 1.0%. In addition, in a case where Hf not substantially added (an inevitable impurity level) as a result of balance with other alloy elements in the alloy, a lower limit of Hf may be 0%.

<B: 0.001 to 0.300%>

Boron is an element that improves grain boundary strength and improves creep strength and ductility. In order to obtain the effect, a boron content is required to be at least 0.001%. On the other hand, boron has a large effect of lowering a melting point. Furthermore, when coarse borides are formed, workability is inhibited. Therefore, it is favorable to control the boron content not exceed 0.300%. A lower limit is preferably 0.003%, and more preferably 0.005%. Furthermore, an upper limit is preferably 0.20%, and more preferably 0.020%.

<Zr: 0.001 to 0.300%>

Zr has an effect of improving grain boundary strength, similar to boron. In order to obtain the effect, a Zr content is at least 0.001%. On the other hand, when the Zr content is excessively increased, a melting point is lowered and high-temperature strength and hot workability is inhibited. Therefore, an upper limit of Zr is 0.300%. A lower limit is preferably 0.005%, and more preferably 0.010%. Furthermore, the upper limit is preferably 0.250%, and more preferably 0.200%.

The balance other than the elements described above is Ni, and of course, includes inevitable impurities.

EXAMPLES

Example 1

The present invention will be described in more detail by way of following Examples.

A Ni-based heat-resistant super alloy was melted under vacuum, and an ingot (ϕ 40 mm*200 mmL) of a Ni-based super alloy A was prepared by lost wax precision casting. A chemical composition of the alloy A is shown in Table 1. In principal, an amount of γ' phase that can precipitate in an equilibrium state and a γ' solvus temperature of the Ni-based super alloy is determined by an alloy composition. The γ' solvus temperature and γ' molar ratio of the alloy A were calculated with use of commercially available calculation software JMatPro (Version 8.0.1, a product manufactured by Sente Software Ltd.). As a result, it was obtained that the γ' solvus temperature was 1188° C. and the γ' mol ratio at 700° C. was 69%.

From the ingot of the alloy A, a sample of ϕ 13 mm*100 mmL was taken for a compression test in a direction parallel to a longitudinal direction of the ingot.

TABLE 1

| C | Cr | Mo | Al | Ti | Nb | Fe | Zr | B | (mass %) Balance |
|---|---|---|---|---|---|---|---|---|---|
| 0.11 | 13.30 | 4.40 | 6.10 | 0.85 | 2.34 | 1.18 | 0.06 | 0.011 | Ni and inevitable impurities |

In a first cold working, the compressed sample of ϕ 13 mm*100 mmL was compressed in multiple passes from a radial direction. Compression directions of different compression passes were as follows:

1st pass: first compression in an arbitrary direction in the radial direction.

2nd pass: second compression by rotating by 90° from the direction of the first compression.

3rd pass: compression by rotating by plus 45° from the direction of the first compression.

4th pass: compression by rotating by minus 45° from on the direction of the first compression.

5th pass: compression by rotating by plus 22.5° from the 1st pass direction.

6th pass: compression by rotating by minus 22.5° from the 1st pass direction.

7th pass: compression by rotating by plus 22.5° from the 2nd pass direction.

8th pass: compression by rotating by minus 22.5° from the 2nd pass direction.

The 2nd pass through the 8th pass were conducted respectively in the above order. Each number of working passes is shown in Table 2. For example, when the working was conducted until the 2nd pass, the number of the working passes was expressed as "2". When the working was conducted until the 8th pass, the number of the working passes was expressed as "8", and so on.

Working ratio was calculated by the above-described equation (1):

$$\text{working (compression) ratio (\%)}=(L0-L1)/L0\times 100\%$$

where L0 and L1 are dimensions before and after the compression in the radial direction for each pass. The compression working was conducted at a room temperature, and compression strain rate was 0.1/s in each case.

Materials having subjected to the first cold working were first-heat-treated at predetermined temperatures for retention times. The conditions of the first cold working are shown in Table 2. For the first heat treatment shown in Table 2, a condition of "subsolvus treatment" indicates heating at 1150° C. for 30 minutes. A condition of "supersolvus treatment (A)" indicates heating at 1200° C. for 5 minutes, and to condition of "supersolvus treatment (B)" indicates heating at 1200° C. for 30 minutes. Note that all samples were air-cooled after the heat treatment.

In addition, a sample for micro observation having a thickness of 5 mm was cut out from a round bar after the first heat treatment. Each sample was observed by an optical microscope from an axial direction of the round bar. An etchant for structure observation was a Kalling's reagent, and recrystallization ratio was calculated by an area ratio of the recrystallized structure. Measurement results of the recrystallization ratio are also shown in Table 2. Microphotographs of Examples and Comparative Examples are shown in FIGS. 1 to 5.

TABLE 2

| | Cold working conditions | | Recrystallization area ratio (%) | | | |
|---|---|---|---|---|---|---|
| No. | Working ratio (%) | Number of working passes | Sub-solvus treat-ment | Super-solvus heat treat-ment (A) | Super-solvus heat treat-ment (B) | Note |
| 1 | 5 | 8 | — | 100% | — | present invention |
| 2 | 8 | 2 | — | 100% | — | present invention |
| 3 | 8 | 4 | — | 100% | — | present invention |
| 4 | 15 | 2 | — | 100% | 100% | present invention |

TABLE 2-continued

| | Cold working conditions | | Recrystallization area ratio (%) | | | |
|---|---|---|---|---|---|---|
| No. | Working ratio (%) | Number of working passes | Sub-solvus treat-ment | Super-solvus heat treat-ment (A) | Super-solvus heat treat-ment (B) | Note |
| 5 | 5 | 8 | — | — | 100% | present invention |
| 6 | 8 | 2 | — | — | 100% | present invention |
| 7 | 8 | 4 | — | — | 100% | present invention |
| 8 | 15 | 2 | — | — | 100% | present invention |
| 11 | 2.5 | 8 | — | 0% | 0% | Comparative Example |
| 12 | 4 | 3 | — | 3% | 4% | Comparative Example |
| 13 | 8 | 4 | 0% | — | — | Comparative Example |
| 14 | 15 | 2 | 0% | — | — | Comparative Example |

From the results of Table 2 and FIGS. 1 to 5, it can be understood that the samples that the first cold working (at a working ratio of not less than 5%) and the first heat treatment (supersolvus heat treatment) defined in the present invention were applied have a sufficient recrystallized structure. On the other hand, in a case where the working ratio of the first cold working step was less than 5%, or the heat treatment was conducted in a temperature range of lower than the temperature of the first heat treatment (supersolvus heat treatment), a recrystallized structure with a ratio of not less than 50% was not obtained.

Example 2

A Ni-based heat-resistant super alloy was melted under vacuum, and an ingot (ϕ 100 mm*110 mmL) of a Ni-based super alloy B was prepared. A chemical composition of the alloy B is shown in Table 3. A γ' solvus temperature and a γ' molar ratio of the alloy B were calculated with use of the commercially available calculation software JMatPro. As a result, it was obtained that the γ' solvus temperature was 1162° C. and the γ' mol % at 700° C. was 46%.

From a ¼ diameter position of the produced ingot of the alloy B, a sample of ϕ 22 mm*55 mmL for a compression test was taken in a direction parallel to an axial direction of the ingot.

TABLE 3

(mass %)

| C | Cr | Mo | W | Co | Al | Ti | Nb | Fe | Zr | B |
|---|---|---|---|---|---|---|---|---|---|---|
| 0.0193 | 15.72 | 3.02 | 1.21 | 15.04 | 2.58 | 4.96 | <0.01 | 0.01 | 0.031 | 0.013 |

* The balance is Ni and inevitable impurities.

As the first cold working, an upsetting working was applied to a round bar of ϕ 22 mm×55 mmL in the axial direction, and the cold working was conducted at a working ratio of 10%. The working ratio was calculated by the above-described equation (2) where the first cold working (compression) was defined as the compression working ratio (%)=(L2− L3)/L2×100%, where L2 and L3 are lengths (heights) before and after the compression working, respectively. A compression test sample which had been worked at a working ratio of 40% in the first cold working was cracked, and thus the sample was not subjected to subsequent first heat treatment.

Next, a first heat treatment was conducted. As conditions of the first heat treatment, the sample was held at a temperature of 1180° C. for 8 hours, then cooled to 500° C. at a cooling rate of 60° C./hour, and taken out from a furnace at 500° C. and air-cooled.

After the first cold working and the first heat treatment, microstructure was observed in the similar manner as in Example 1, and it was confirmed that recrystallization ratio was 100%. Furthermore, recrystallized grain size was evaluated by an ASTM method, and an average grain size was 320 μm.

On the sample after the compression test, which had been passed through the first cold working and the first heat treatment, a second cold working at a working ratio of 30% was further conducted in a upset compression manner in the axial direction, and then a second heat treatment was applied. For conditions of the second heat treatment, the sample was held at a temperature of 1130° C. for 30 minutes and then air-cooled.

Figure 6:
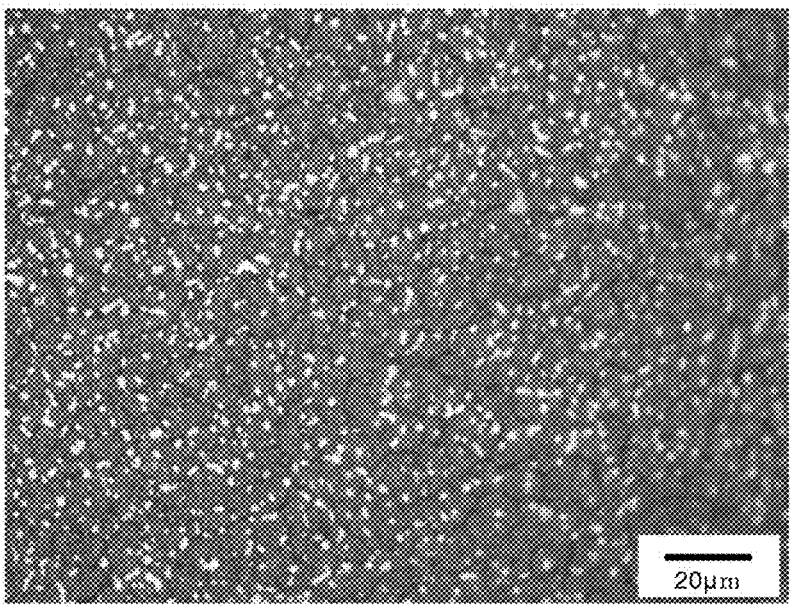
FIG. 6 is a photograph of a metal structure of a Ni-based heat-resistant super alloy produced by the production method according to the present invention, that is made of No. B alloy subjected to a first cold working and a first heat treatment and further to a second cold working and a second heat treatment.

The sample after the compression test, to which the second cold working and the second heat treatment had been applied, was cut so as to pass through a center line in a longitudinal direction, and microstructure at ¼ D (D is a diameter) position was observed. Electrolytic corrosion was employed (electrolytic etchant: 10% oxalic acid aqueous solution, voltage: 4 V, and etching time; 2 seconds). The resulting structure is shown in FIG. 6, and an average grain size was 10.6 μm (ASTM #9.7).

From the results, it is understood that the method for producing a Ni-based heat-resistant super alloy defined in the present invention can provide sufficiently refined grains.

Example 3

A Ni-based heat-resistant super alloy was melted under vacuum, and an ingot (ϕ 100 mm*110 mmL) of a Ni-based super alloy C was prepared. A chemical composition of the alloy C is shown in Table 4. A γ' solvus temperature and a γ' molar ratio of the alloy C were calculated with use of the commercially available calculation software JMatPro. As a result, it was obtained that the γ' solvus temperature was 1235° C. and the γ' mol % was 72%.

From a ¼ diameter position of the produced ingot of the alloy C, a sample of ϕ 22 mm*55 mmL for a compression test was taken in a direction parallel to an axial direction of the ingot.

TABLE 4

(mass %)

| C | Cr | Mo | V | Co | Al | Ti | Nb | Fe | Zr | B |
|---|---|---|---|---|---|---|---|---|---|---|
| 0.0149 | 9.80 | 2.93 | 0.67 | 15.12 | 5.48 | 4.55 | <0.01 | 0.10 | 0.046 | 0.013 |

* The balance is Ni and inevitable impurities.

As the first cold working, an upsetting working was applied to a round bar of ϕ 22 mm×55 mmL in the axial direction, and the cold working was conducted at a working ratio of 10%. The working ratio was calculated by the above equation (2). A compression test sample, which had been worked at a working ratio of 40% in the first cold working was cracked, and thus the sample was not subjected to the subsequent first heat treatment.

Next, a first heat treatment was conducted. As conditions of the first heat treatment, the sample was held at a temperature of 1250° C. for 8 hours, then cooled to 500° C. at a cooling rate of 60° C./hour, and taken out from a furnace at 500° C. and air-cooled.

After the first cold working and the first heat treatment, microstructure was observed in the similar manner as in Example 1, and it was confirmed that recrystallization ratio was 100%. Furthermore, recrystallized grain size was evaluated by an ASTM method, and an average grain size was 290 μm.

On the sample after the compression test, which had been passed through the first cold working and the first heat treatment, a second cold working at a working ratio of 30% was further conducted in the axial direction, and then a second heat treatment was applied. For conditions of the second heat treatment, the sample was held at a temperature of 1200° C. for 30 minutes and then air-cooled.

Figure 7:
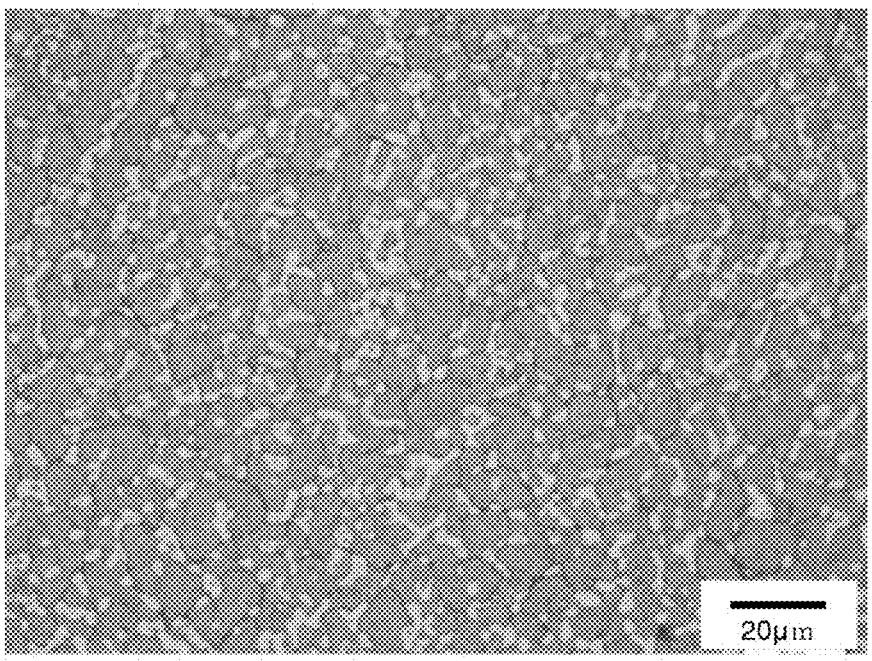
FIG. 7 is a photograph of a metal structure of a Ni-based heat-resistant super alloy produced by the production method according to the present invention, that is made of No. C alloy subjected to a first cold working and a first heat treatment and further to a second cold working and a second heat treatment.

The sample after the compression test, to which the second cold working and the second heat treatment had been applied, was cut so as to pass through a center line in a longitudinal direction, and microstructure at ¼ D (D is a diameter) position was observed. Electrolytic corrosion was employed (electrolytic etchant: 10% oxalic acid aqueous solution, voltage: 4 V, and etching time: 1.5 seconds). The resulting structure is shown in FIG. 7, and an average grain size was 9.8 μm (ASTM #10).

From the results, it is understood that the method for producing a Ni-based heat-resistant super alloy defined in the present invention can provide sufficiently refined grains.

Example 4

A Ni-based heat-resistant super alloy was melted under vacuum, and an ingot (ϕ 100 mm*110 mmL) of a Ni-based super alloy D was prepared. A chemical composition of the alloy D is shown in Table 5. A γ' solvus temperature and a γ' molar ratio of the alloy were calculated with use of the commercially available calculation software JMatPro. As a result, it was obtained that the γ' solvus temperature was 1159° C. and the γ' mol % at 700° C. was 47%.

TABLE 5

(mass %)

| C | Cr | Mo | W | Co | Al | Ti | V | Fe | Zr | B |
|---|---|---|---|---|---|---|---|---|---|---|
| 0.016 | 15.78 | 3.02 | 1.24 | 15.08 | 2.56 | 4.97 | 0.01 | 0.03 | 0.032 | 0.013 |

* The balance is Ni and inevitable impurities.

From a ¼ diameter position of the produced ingot of the alloy D, a sample of ϕ 22 mm*35 mmL for a compression test was taken in a direction parallel to an axial direction of the ingot.

As the first cold working, a round bar of ϕ 22 mm×35 mmL was upset forged in an axial direction. A working ratio of the forging was 10%. The working ratio was calculated in accordance with the equation (2). Next, a first heat treatment was conducted. For conditions of the first heat treatment, the sample was held at a temperature of 1180° C. for 8 hours, then cooled to 500° C. at a cooling rate of 60° C./hour, and taken out from a furnace at 500° C. and air-cooled.

A tensile test piece was taken from the heat-treated material, and subjected to a tensile test. As the tensile test piece, a small type of the ASTM standard was employed. A full test length was 30 mm, a gauge length was 7 mm, and a diameter was 2 mm. A strain rate was 0.1/S, and the tensile test was conducted at room temperature (22° C.) and 800° C. The test temperature of 800° C. simulated hot working such as decomposition forging. As a comparative example, a tensile test piece was taken from an as-case material, and subjected to a tensile test under the same conditions. The results are shown in Table 6.

TABLE 6

| No | First cold working step and first heat treatment step | 22° C. Elongation (%) | 22° C. Reduction of area (%) | 800° C. Elongation (%) | 800° C. Reduction of area (%) | Remarks |
|---|---|---|---|---|---|---|
| 1 | Not conducted | 13.1 | 15.4 | 10.4 | 10.9 | Comparative Example |
| 2 | Conducted | 19.4 | 19.2 | 32.1 | 59.3 | The present invention |

As shown in Table 6, it can be understood that the first cold working and the first heat treatment of the present invention drastically improved high temperature ductility of the hard-to-work Ni-based heat-resistant super alloy having a γ' mol % of not less than 40%.

In general, when a value of the reduction of area is secured to be around 60% in hot working at 1050 to 1100° C., the hot working can be successively performed. As shown in Table 6, the present invention can provide the reduction of area to be around 60%, even at a relatively low temperature of 800° C. Since hot working is generally conducted at a temperature of higher than 800° C., it is understood that the hot working can be easily performed by applying the method of the present invention.

From the above, when the method for producing a Ni-based heat-resistant super alloy according to the present invention is applied, for example, to a production of an intermediate material for blooming, hot working such as blooming forging, of a hard-to-work Ni-based super alloy having a γ' molar ratio of not less than 40% can be easily conducted. Such alloy has been conventionally considered difficult to hot-work of hot forging or the like. In this way, a high γ'-Ni-based heat-resistant super alloy can be used for producing e.g. a high-performance turbine disk for an aircraft or for power generation.

The invention claimed is:

1. A method for producing a Ni-based heat-resistant super alloy, comprising:

preparing an ingot of the Ni-based heat-resistant super alloy having such a composition that the alloy includes not less than 40 mol % of a gamma prime (γ') phase;

a first cold work step of cold-working the ingot at a working ratio of not less than 5% but less than 30%; and a first heat treatment step of heat-treating the first-cold-worked material at a temperature exceeding a solid solution temperature of the gamma prime phase.

2. The method according to claim 1, wherein the first heat treatment is conducted at a temperature not higher than the gamma prime solid solution temperature plus 40° C. and lower than a solidus temperature of the alloy.

3. The method according to claim 1, wherein the first cold work is conducted by forging, elongation working, or injection working, or a combination thereof.

4. The method according to claim 1, wherein the alloy comprises, by mass:

0.001 to 0.250% C,
8.0 to 22.0% Cr,
not more than 28.0% Co,
2.0 to 7.0% Mo,
not more than 6.0% W,
2.0 to 8.0% Al,
0.5 to 7.0% Ti,
not more than 4.0% Nb,
not more than 3.0% Ta,
not more than 10.0% Fe,
not more than 1.2% V,
not more than 1.0% Hf,
0.001 to 0.300% B,
0.001 to 0.300% Zr, and
the balance of Ni and inevitable impurities.

5. The method according to claim 1, further comprising:

a second cold work step of cold-working the first-heat-treated material at a working ratio of not less than 20%; and a second heat treatment step of heat-treating the second-cold-worked material at a temperature lower than the gamma prime solid solution temperature.

6. The method according to claim 5, wherein the second heat treatment is conducted at a temperature not lower than the gamma prime solid solution temperature minus 80° C.

7. The method according to claim 5, wherein the first cold working or the second cold working is conducted by forging, elongation working, or injection working, or a combination thereof.

* * * * *